US007055682B1

(12) United States Patent
Domotor et al.

(10) Patent No.: US 7,055,682 B1
(45) Date of Patent: Jun. 6, 2006

(54) PADFOLIO WITH COMPARTMENTALIZED INTERIOR

(75) Inventors: Agnes Csilla Domotor, Jamaica Plain, MA (US); Joshua B. Lederer, Brookline, MA (US); Mark T. Salander, Barrington, RI (US)

(73) Assignee: The Gem Group, Inc., Lawrence, MA (US)

( * ) Notice: Subject to any disclaimer, the term of this patent is extended or adjusted under 35 U.S.C. 154(b) by 141 days.

(21) Appl. No.: 10/447,361

(22) Filed: May 29, 2003

(51) Int. Cl.
*A45C 11/34* (2006.01)

(52) U.S. Cl. ..... 206/214; 206/224; 206/371; 281/30; 281/44

(58) Field of Classification Search ..... 206/214, 206/224, 371, 305, 320, 472, 473; 150/106, 150/131, 135; 281/29, 30, 31, 15.1, 44
See application file for complete search history.

(56) References Cited

U.S. PATENT DOCUMENTS 4,061,170 A * 12/1977 Marks ..... 206/278
5,065,922 A * 11/1991 Harris ..... 224/901.8
5,205,448 A * 4/1993 Kester et al. ..... 224/901.8
5,351,992 A * 10/1994 Chilson et al. ..... 281/31
5,366,070 A * 11/1994 Wolov ..... 206/214
5,388,689 A * 2/1995 Kroop et al. ..... 206/214
5,445,266 A * 8/1995 Prete et al. ..... 206/320
5,447,215 A * 9/1995 Volkmar et al. ..... 206/214
5,671,951 A * 9/1997 Palmiter et al. ..... 281/31
5,820,095 A * 10/1998 Stone ..... 281/30
6,264,029 B1 * 7/2001 Motson ..... 206/320
6,578,706 B1 * 6/2003 Thompson ..... 206/214

OTHER PUBLICATIONS

U.S. Appl. No. 29/182,622, filed May 29, 2003 by Lederer et al. for Surface-Mount Pen Holder, all pages.

* cited by examiner

*Primary Examiner*—Luan K. Bui
(74) *Attorney, Agent, or Firm*—Cesari and McKenna, LLP; William A. Loginov

(57) ABSTRACT

A padfolio having, along at least one cover's interior, a raised, substantially rigid tray structure that defines plurality of compartments with dividing walls therebetween is provided. The surface of the tray structure is covered in a fastener material that removably interengages with an opposing fastener material that is applied to a set of pockets, pouches, electronic devices, pen holders, clocks, calculators and other items. In one embodiment, the fastener material consists of a loop material formed along the tray and a hook material attached to an underside of each of the various attachable items. In this manner, the pockets, pouches or other items can be freely or variably placed anywhere along the loop surface, in any of the compartments, at a wide variety of locations therein. A pen holder for the padfolio or other business accessory is constructed from a flexible material that defines a barrel with a top slot formed between a pair of opposing side walls and a base. The side walls include undulating top edges that define the slot and facilitate passage of the pen therethrough. The penholder can have a linear groove along the base on the barrel interior to guide a stitch for fixed attachment to the padfolio or other business accessory.

15 Claims, 5 Drawing Sheets

PADFOLIO WITH COMPARTMENTALIZED INTERIOR

RELATED APPLICATIONS

The present application is related to the teachings of commonly assigned U.S. patent application Ser. No. 29/182,622, now issued as U.S. Pat. No. D486,523, filed on even date by Joshua B. Lederer et al. for a SURFACE-MOUNT PEN HOLDER, which are expressly incorporated herein by reference.

BACKGROUND OF THE INVENTION

1. Field of the Invention

This invention is related to padfolios and associated business accessories, and more particularly to interior holders in such padfolios and associated business accessories.

2. Background Information

A padfolio is a folder having a front and back cover, joined by a spine, which can be sealed with a zipper or other closure that extends around the perimeter between the two opposing ends of a spine. Padfolios are useful business accessories, typically containing a notepad on the interior of one cover and a set of pockets or pouches on the interior of the opposing cover. The pocket-containing cover can be provided with a variety of sleeves, pouches and closures for storing various items. For example, some pockets or pouches can store calculators or personal digital assistants (PDAs). Typically, pockets are fixed to the interior of the cover using adhesives, stitching or other attachment mechanisms. Thus, the user is often limited in what pockets or pouches are available and where they are placed. However, some users may desire an alternate arrangement or placement and the ability to substitute various items (e.g. different pouches, devices, etc.) within the interior space. For example, if one is left-handed he or she may wish to reverse the placement of certain items within the space. Or, if certain items are used more frequently than others, easier access to those frequently used items by the user's hand may be desired. Accordingly, it would be desirable to provide further versatility to the placement and types of pockets, pouches and other items that can be placed along the interior of the padfolio cover.

SUMMARY OF THE INVENTION

This invention overcomes the disadvantages of the prior art by providing a padfolio having, along at least one cover's interior, a raised, substantially rigid tray structure that defines plurality of compartments with dividing walls therebetween. The surface of the tray structure is covered in a fastener material that removably interengages with an opposing fastener material that is applied to a set of pockets, pouches, electronic devices, pen holders, clocks, calculators and other items. In one embodiment, the fastener material consists of a loop material formed along the tray and a hook material attached to an underside of each of the various attachable items. In this manner, the pockets, pouches or other items can be freely or variably placed anywhere along the loop surface, in any of the compartments, at a wide variety of locations therein.

The padfolio or another business accessory can be provided with a pen holder constructed from a flexible material that defines a barrel with a top slot formed between a pair of opposing side walls and a base. The side walls flex when a pen or other shaft-like writing implement is driven through the slot and then frictionally engage the shaft under spring tension. The side walls include undulating top edges that define the slot and facilitate passage of the pen therethrough. The pen holder may include a strip of hook material and can also have a linear groove along the base on the barrel interior to guide a stitch for fixed attachment to the padfolio or other business accessory.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
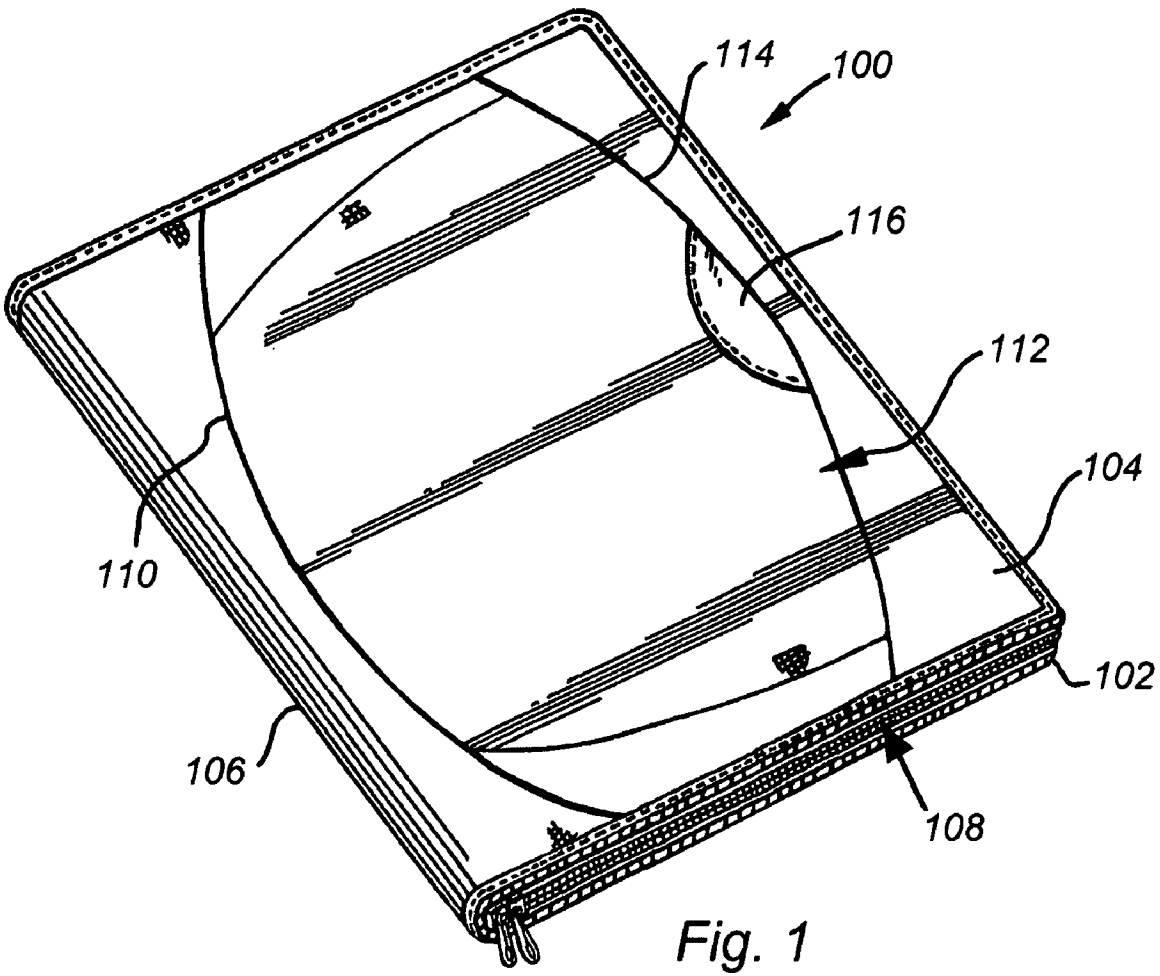
FIG. 1 is an isometric view of a padfolio according to an illustrative embodiment of the invention shown in a closed position.

A padfolio 100 according to an illustrative embodiment of this invention is shown in FIG. 1. In a closed position, the padfolio consists of a bottom (or back) cover 102, a top (or front) cover 104, a spine 106 that joins the bottom and top covers 102, 104 together and a peripheral closure comprising, in this embodiment, a zipper 108 that secures the top and bottom covers together. The covers can be provided with decorative stitching and seams 110. These seams can form an outer pocket 112 having a decoratively curved edge 114. At the top of the edge 114 is provided a decorative raised surface 116. In this embodiment, the raised surface 116 is constructed from soft polyvinylchloride (PVC), and is stitched in place. Note that the various pockets and seams formed on the outer surfaces of the covers are exemplary only, and a variety of shapes can be employed. Likewise, the covers can be plain without any surface decoration or pockets.

Figure 2:
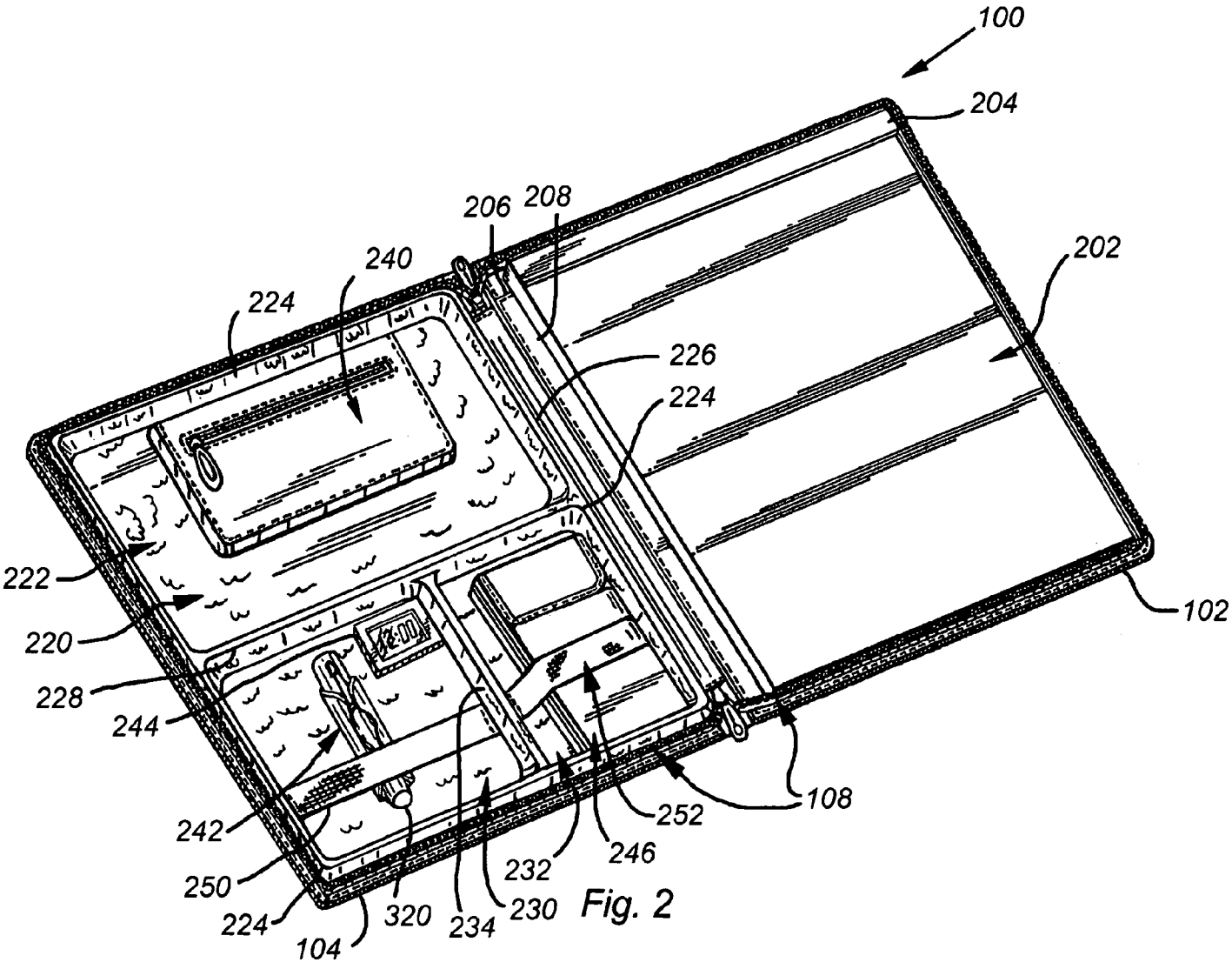
FIG. 2 is an isometric view of the padfolio of FIG. 1 shown in an open position.

The padfolio 100 is shown in a fully opened orientation/position in FIG. 2. Along the interior of the bottom cover 102 is mounted a removable notepad 202. The notepad has a spine 204 at its upper end that secures a set of leaves together. Typically, the leaves can each be removed from the spine by tearing the perforations (not shown) or by a variety of other techniques. However, and notepad construction can be employed (or a notepad can be omitted entirely in an alternate embodiment). The pad generally includes a stiff cardboard backing 206 that is slid through the top edge of an open pocket 208 on the bottom cover's interior. The pocket 208 secures the notepad 202 within the confines of the bottom cover 102. The notepad can be slid out of the pocket for removal or replacement.

A raised tray structure 220 along the interior of the opposing top cover 104 is provided according to an illustrative embodiment of this invention. In the exemplary embodiment, the tray 220 includes a full-width upper compartment 222 surrounded by an outer wall structure 224 that is adjacent to and confronts the zipper 108, and also extends aside the interior spine 226. The bottom side of the compartment 222 is bound by a central raised wall 228. This raised wall (228) also provides the upper boundary of a pair of side-by-side bottom compartments 230 and 232. The sides and shared bottom of these compartments 230, 232 are bounded by the tray's peripheral outer wall 224. The two compartments 230, 232 are separated from each other by a vertically (lengthwise) aligned raised wall 234. This vertical wall 234 extends between the central widthwise wall 228 and the lower portion of the outer wall 224. It is expressly contemplated that the arrangement, size and number of compartments according to this invention is highly variable.

In general, walls are provided to separate the compartments from each other. The height H (see FIG. 4) of the walls is chosen so that, when the padfolio is closed, the zipper assembly 108 meshes together without undue tension. The wall height H may be greater than one half of the zipper assembly (e.g. each cover generally having one half the total width of the zipper 208), but overall the combination of the zipper assembly and overlying notepad are less than or equal to the expansion width of the zipper assembly. Similarly, the central compartment-dividing walls 228 and 234 may be lower in height than the surrounding outer wall 224. As will be described further below, the surface of the tray 220 is covered in a material that functions as a fastener. In this embodiment, brushed polyester Tricot, a synthetic with loop fastener characteristics is used. When engaged to opposing hook material, a removable interengagement between the hook material and the Tricot is attained.

As shown in FIG. 2, the tray 220 houses a variety of business accessories or other items. For example, a purse or wallet 240 is housed in the large compartment 222. A penholder 242 and digital clock 244 are housed in the lower compartment 230. Likewise, a pouch 246, containing a personal digital assistant, cellular phone or other accessory is housed in the lower compartment 232. A pair of optional elastic webbing straps 250 and 252 extend across the width of each respective compartment 230 and 232. They are typically stitched to the tray at opposing ends. These straps can assist in holding items within the compartments. Their width and elasticity are highly variable. Non-elastic straps, with or with out buckles or clasps, can be substituted.

Figure 3:
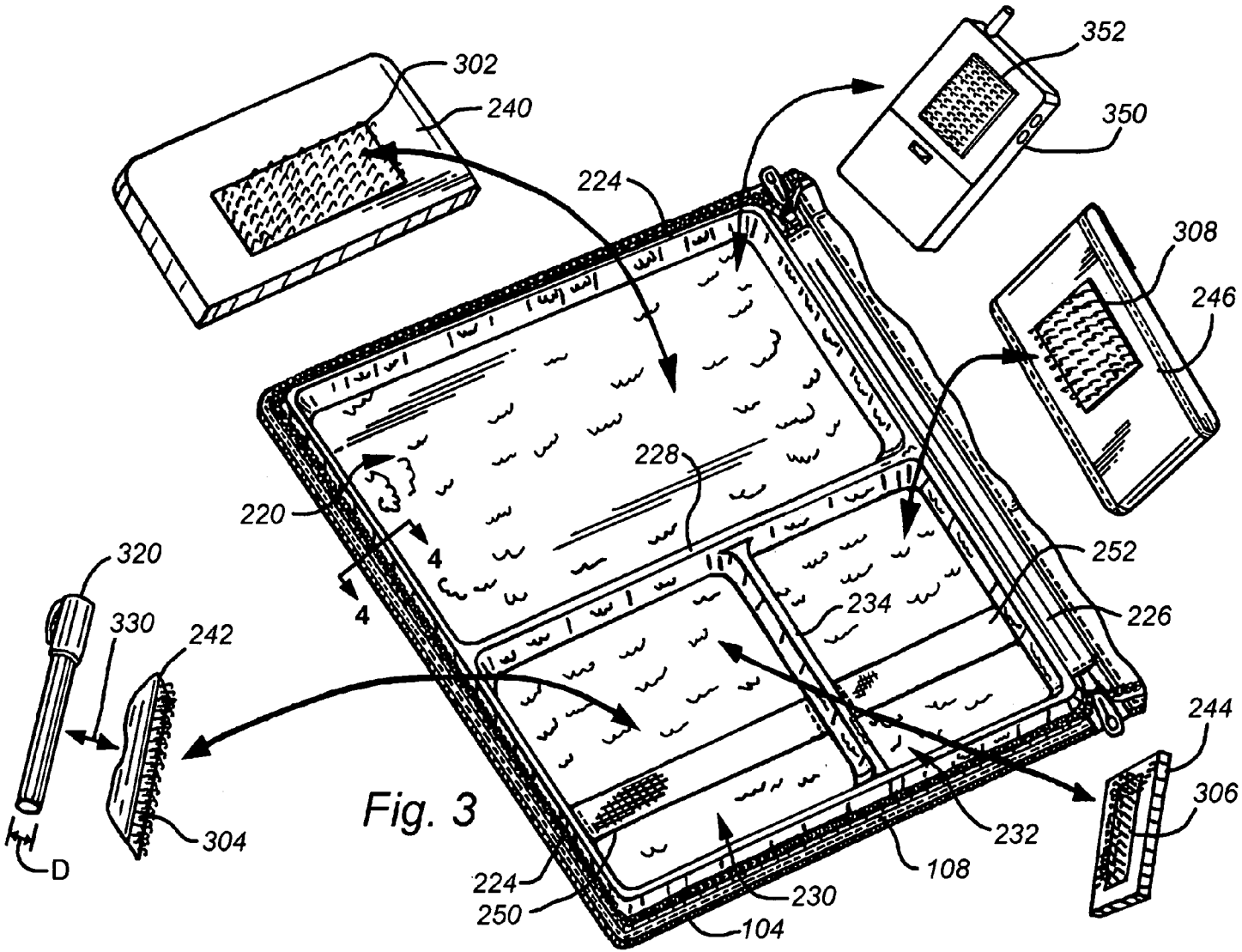
FIG. 3 is a partial isometric view of the padfolio of FIG. 2 showing each of the items removed from the tray.

As shown in FIG. 3, the tray 220 is engaged by items 240, 242, 244 and 246 each having a strip of hook material 302, 304, 306 and 308, respectively, mounted along its underside. The hook material can be any acceptable hook material designed to interengage with a fabric. In this embodiment, the loop material fabric covering the tray 220 is commercially-available Tricot. Hook material is commercially available in self-adhesive strips that can be provided with the padfolio 100 of this invention upon sale. One well-known manufacturer of hook tape and loop material fabric in a variety of sizes and performance characteristics is Velcro USA of Manchester, N.H. While self-adhesive hook tape may be employed for may items (particularly those added by the user), hook material can also be pre-stitched to certain accessories (usually provided with the padfolio at sale time) such as the wallet 240 and pouch 246. The length and width (e.g. surface area) of the hook material should be sufficient to provide a positive, yet removable engagement of the item to the tray—given the item's particular weight and size. The hook material can be provided as a single strip on the item or multiple strips at spaced locations where appropriate due to the size and shape of the item.

Figure 5:
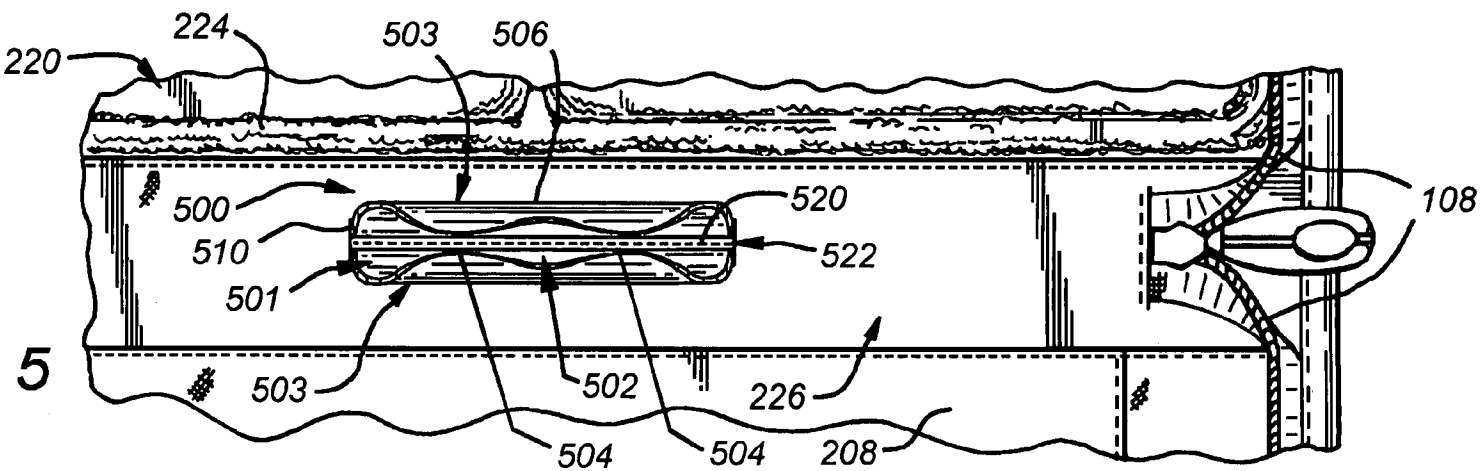
FIG. 5 is a partial plan view of an alternate embodiment of the padfolio of FIG. 1 including a fixedly attached penholder along the interior of the spine.
Figure 6:
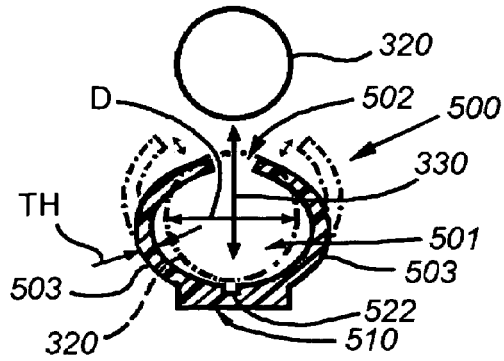
FIG. 6 is a side cross section of the pen holder in a flexed and unflexed position.
Figure 7:
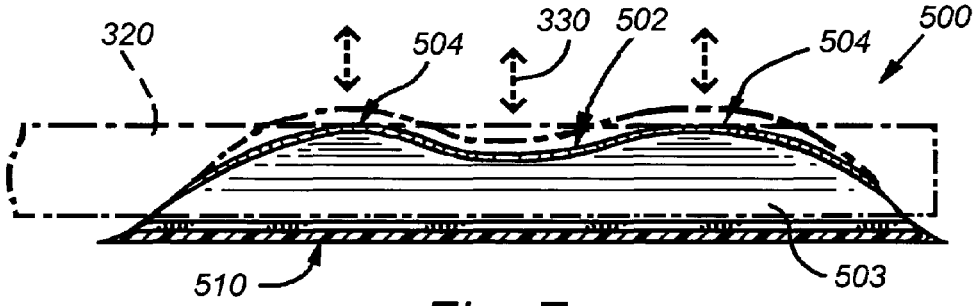
FIG. 7 is a side view of the pen holder in a flexed and unflexed position.

Notably, the penholder 242, is constructed from a pliable material such as soft polyvinylchloride or synthetic rubber that flexes widely under force, but retains its original shape when force is removed. The material may also exhibit moderate-to-strong frictional resistance to retain a grip on the inserted pen. With further reference to FIGS. 5, 6 and 7, a penholder 500 substantially similar to the detachable penholder 242 is shown. This exemplary penholder 500 includes an open barrel 501 defined by the side walls 503, the base 510 and the central slot 502. The inner barrel 501 of the penholder 500 may have a resting diameter (shown in FIG. 6) that, in at least some areas of its circumference, is sufficiently small to grippingly engage the diameter D of a conventional pen or pencil 320. This diameter D can be between approximately ¼ inch and ½ inch and may be ovular or otherwise non-circular (in which case the barrel diameter may define the minor and/or major axis of an oval). In other words, the side walls 503, defining a smaller barrel than the pen diameter, must be flexed into tension when the pen is seated in the barrel 501, causing portions of the side walls to apply frictional holding force to the walls of the pen.

The upper edge of each side wall 503 (adjacent to the slot 502) is provided with a pair of undulating wave-like peaks 504 between an adjacent central valley 506. The spacing within the slot 502 between the peaks 504 on opposing side walls 503 can be between approximately ⅛ and ¼ inch, while the slot spacing between the valleys is typically between approximately ¼ and ⅜ inch. However, the size of the slot spacings can vary depending upon the size of pens or pencils to be engaged. This wave-like edge structure allows a pen to be pushed directly into the split 502 as indicated by the double arrow 330 (FIG. 3). When pushed downwardly (laterally), the slot 502 is forcibly widened as shown in phantom in FIGS. 6 and 7 by springing away the side walls to allow the pen to pass through the slot 502 and into the barrel 501. Alternatively, a pen can be slid axially into the barrel from either open end of the penholder 500. The overall length of the penholder can be approximately 1½ to 2 inches in an illustrative embodiment. In this embodiment, the thickness TH of the side walls 503 of the penholder is approximately 1/16–⅛ inch. However other thicknesses (or a varying thickness are expressly contemplated—depending in part on the flexibility and strength of the underlying material from which the penholder is constructed.

The base 510 of the penholder 242 or 500 is relatively flat, thus allowing the strip 304 of hook material to be securely mounted on the penholder (i.e. penholder 242) as appropriate. In this manner, the penholder 242 can be placed variably at any position within the compartment for greater ease of use. It can be placed vertically, horizontally or diagonally with respect to the up-to-down orientation of the padfolio. Likewise, a unique clock 244 is provided with a strip 306 of hook material. The clock can be placed at any position within the tray that is convenient. Appropriate set buttons and battery-access ports can be provided to the clock. While a digital clock is shown, an analog clock can be substituted. Likewise, other business accessories or electronic devices including a calculator, PDA or cellular phone (such as the exemplary cellular phone 350) can be provided with a piece of hook material (352) so that they are easily attachable and detachable from the compartment. For the purposes of this description, therefore, the term device and/or business accessory should include any such item that can be removably attached to the tray and fit within the padfolio when it is closed.

Figure 4:
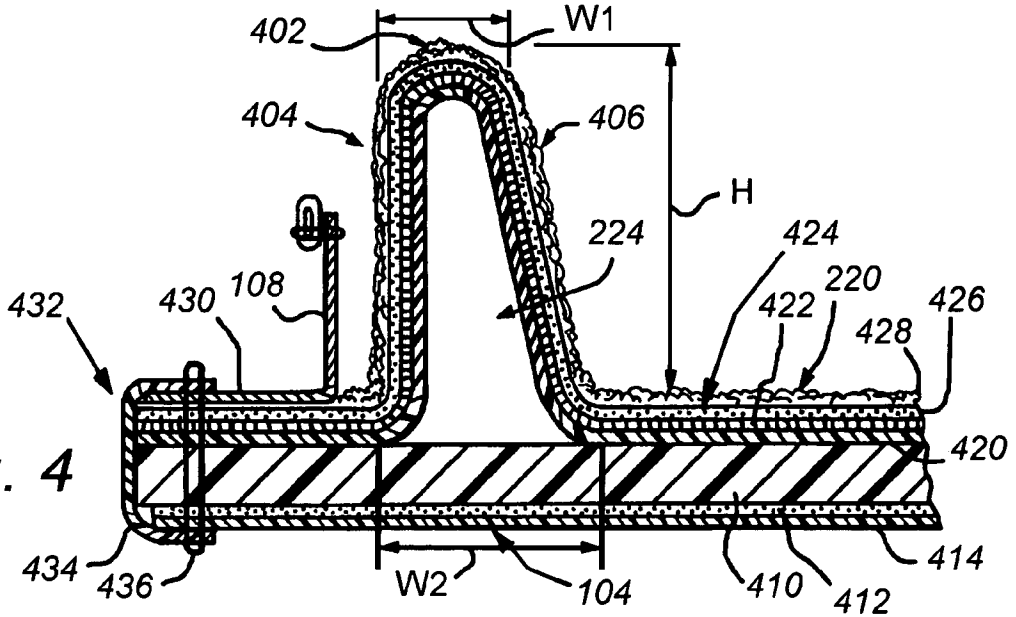
FIG. 4 is a partial cross-section through line 4—4 of FIG. 3.

The construction of the tray, in conjunction with the padfolio, is shown in further detail in FIG. 4. In FIG. 4, the outer wall 224 is shown in further detail, along with the adjacent bottom cover 104. The height H of the wall, from the base of the tray 220, is between ½ inch and 1 inch approximately. However, the height can vary widely. The wall 224 tapers from the base to its peak 402. At the peak, the outer width W1 is between approximately ¼ inch and ½ inch. Likewise, the width W2 at the base is between approximately ⅜ inch and ¾ inch. However, these dimensions are widely variable as well. As shown, the outer wall 224 has a relatively vertical outer face (with respect to the flat plane of the tray base and cover) and the inner face 406 is at a more-acute angle with respect to the vertical. It is contemplate, in an alternate embodiment, that the taper angle of each wall face 404 and 406 can be more equal. The inner walls 228 and 234 may also have a more-equal taper angle. The bottom cover 104 consists of a central stiffener 410 constructed from cardboard or another somewhat rigid material. It is approximately ⅛ inch to ¼ inch thick. A padding layer 412, constructed from foam or another pliable material is provided on the outer face and this is covered with a layer of covering material 414 that can be leather, synthetic or fabric. Along the upper or interior side of the stiffener 410 is mounted the tray backing 410. The backing is constructed from a solid piece of plastic or another suitable material. In one embodiment, the plastic comprises a vacuum-formed ethylvinylacetate (EVA). However, a variety of materials can be used. The thickness of the backing 420 is approximately 4 mm. It is formed, particularly, by heating a sheet of EVA and then applying a vacuum so that it molds around a rigid form. When cool, the formed sheet is removed. Over the backing is provided an adhesive layer 422. The adhesive layer secures the Tricot layer 424. The Tricot comprises a fabric backing 426 with plush loop material 428 projecting therefrom. Zipper assembly 108 includes a base piece 430 that is provided over the tricot near the outer edge 432 of the cover 104. A piece of edge piping 434 wraps around the entire construction and is joined by a stitched seam 436. The various layers can be joined by additional stitching and/or adhesives where appropriate.

As described above, the penholder 500 (for example) allows a pen to be directed through the slot 502 to be engaged by the interior barrel 501 of the penholder 500. The undulating peaks 504 and valleys 506 concentrate pressure as the pen is driven through the slot so that the penholder sides spring away from each other to widen the slot as the pen passes therethrough. While the penholder 242, having a relatively flat bottom 510, can be fitted with an adhesively attached (or integrally molded) strip of hook, it can also be permanently mounted (see FIG. 5) at an appropriate position on the padfolio using stitching 520 placed along a central channel 522 formed in the bottom of the penholder barrel 501. The channel 522 extends along approximately the full length of the penholder, and is approximately 1/16 inch to 3/16 inch thick wide. Its depth is highly variable, but can be approximately 1/16 inch. In this embodiment, the penholder 500 is mounted along the interior spine 226 between the two covers. A variety of other fixed mounting locations on the padfolio (or another business accessory) are contemplated.

The foregoing has been a detailed description of illustrative embodiments of this invention. Various modifications and additions can be made without departing from the spirit and scope thereof. For example, additional pockets or compartments can be provided within either the bottom or top cover interior. Some items in the top cover interior can be fixed and the tray need not fill the entire top cover but, rather, can be located on only a part of the top cover interior, with the remainder of the top cover being used for pockets and other fixed structures. Additionally, it is expressly contemplated that the pen holder shown and described herein can be removably or fixedly attached to a variety of other business accessories including notepad covers, bags and portfolios and this description should be taken broadly to include such alternate attachment substrates. Finally, while a holder for a pen is shown, it can be used to hold any shaft-like writing implement including a pencil, crayon, marker or chalk. Accordingly, this description is to be taken only by way of example and not to otherwise limit the scope of the invention.

What is claimed is:

1. A padfolio having an interior compartment comprising:

a bottom cover including a notepad removably mounted thereon;

a top cover having a plurality of compartments; and the plurality of compartments being defined by a plurality of raised walls with hook and loop fastener material located within each compartment and extending to respective of the raised walls that define each of the compartments for removably and variably mounting an item with opposing hook and loop material attached to the item wherein the item may be mounted in any compartment of the plurality of compartments.

2. The padfolio as set forth in claim 1 wherein the top cover interior is substantially covered entirely by the plurality of compartments.

3. The padfolio as set forth in claim 1 wherein the item is an electronic device.

4. The padfolio as set forth in claim 3 wherein the fastener material mounted on the electronic device is self-adhesive strip.

5. The padfolio as set forth in claim 1 wherein the item is at least one of a penholder, a pouch and a clock.

6. The padfolio as set forth in claim 5 wherein the penholder comprises an elastomeric material defining side walls and an inner barrel, the side walls including a split so that a pen can pass through the split upon application of force.

7. The padfolio as set forth in claim 1 wherein the compartment includes an elastic webbing extending thereacross for holding additional items in the compartment.

8. The padfolio as set forth in claim 1 wherein the tray includes an inner backing constructed from a formed sheet of plastic and having adhered thereto an outer fabric material that defines a loop fastener.

9. The padfolio as set forth in claim 1 further comprising a plurality of additional items, each of the additional items having the second element of fastener material mounted thereto and each of the additional items being selectively, variably, and removably mountable within the compartment so as to each be movable about the compartment to a plurality of variable locations with the first element of fastener material in engagement with the second element.

10. A padfolio having a pair of opposing covers, each with a cover interior comprising:

a pad holder on a first cover interior; and a second cover interior substantially covered by a plurality of compartments, where the plurality of compartments are each defined by a plurality raised walls that surround hook fastener material or loop fastener material that engages an opposing, interengaging loop element or hook element, respectively, mounted on an item so that the item is capable of being removably and variably mounted on the second cover interior so as to be movable about one compartment of the plurality of compartments and different compartments of the plurality of compartments where the hook and loop elements of the fastener material are in engagement.

11. The padfolio as set forth in claim 10 wherein the second cover interior is a substantially covered by the plurality of compartments.

12. The padfolio as set forth in claim 10 wherein each compartment of the plurality of compartments is of unequal size.

13. The padfolio as set forth in claim 12 wherein the item is at least one of a pen holder, a pouch, a wallet, a clock and an electronic device.

14. The padfolio as set forth in claim 10 wherein the item is at least one of a pen holder, a pouch, a wallet, a clock and an electronic device.

15. The padfolio as set forth in claim 10 further comprising a plurality of additional items, each of the additional items having the loop or hook element of fastener material mounted thereto and each of the additional items being selectively, variably, and removably mountable on the second cover interior so as to each be movable about the second cover interior to a plurality of variable locations with the hook and loop elements of fastener material in engagement.

* * * * *